United States Patent [19]

Immekus

[11] 4,336,922

[45] Jun. 29, 1982

[54] CONTINUOUSLY TAPPED CUPOLA FURNACE

[75] Inventor: Karl Immekus, Kaarst, Fed. Rep. of Germany

[73] Assignee: Gesellschaft für Hüttenwerksanlagen mbH, Duesseldorf, Fed. Rep. of Germany

[21] Appl. No.: 154,366

[22] Filed: May 29, 1980

[30] Foreign Application Priority Data

Jun. 8, 1979 [DE] Fed. Rep. of Germany ..... 2923221

[51] Int. Cl.[3] ..... C21B 3/04

[52] U.S. Cl. ..... 266/227; 266/221; 266/236; 266/232; 266/900

[58] Field of Search ..... 266/197, 227, 900, 232, 266/236, 221

[56] References Cited

U.S. PATENT DOCUMENTS

| | | | |
|---|---|---|---|
| 1,717,813 | 6/1929 | Steffe | 266/231 |
| 2,543,420 | 2/1951 | Ogg | 266/227 |
| 2,878,011 | 3/1959 | Sherban | 266/900 |
| 2,892,005 | 6/1959 | Lang | 266/900 |
| 3,539,169 | 11/1970 | Higgs | 266/900 |
| 3,558,791 | 1/1971 | Grachev | 266/900 |
| 4,238,231 | 12/1980 | Dunks | 75/53 |

OTHER PUBLICATIONS

Metallurgist No. 7/8, vol. 19, p. 492.

*Primary Examiner*—P. D. Rosenberg
*Attorney, Agent, or Firm*—Toren, McGeady & Stanger

[57] ABSTRACT

A hot-blast cupola furnace 1 has an inclined bottom 3 leading directly to a tapping conduit 4. The conduit 4 leads to a forehearth 5 having an iron discharge siphon 13, 14, 15 and two slag discharge siphons 16, 17. The forehearth 5 has an upper slag-holding part 10 and a lower iron-holding part 11, which also contains slag in its upper part down to the level of the tops of the siphons 16, 17. The part 10 is of greater horizontal cross-sectional area than the part 11. In this way the height of the slag column through which the iron passes in the forehearth is reduced and so is the area of the boundary layer in the forehearth. This causes the reaction between the iron and the slag to take place predominantly in the main furnace zone above the bottom 3 and not in the forehearth and in this way the life of the lining of the forehearth, which is a limiting factor on the possible continuous period of operation of the furnace, is prolonged.

13 Claims, 3 Drawing Figures

CONTINUOUSLY TAPPED CUPOLA FURNACE

This invention relates to continuously tapped cupola furnaces, particularly hot blast cupola furnaces, having an inclined furnace bottom, a forehearth, a tapping conduit leading from the furnace bottom to the forehearth and siphons for discharging iron and slag from the forehearth.

Such cupola furnaces are known, for example, from German Patent No. 12 17 027. The furnace bottom is in permanent communication via the tapping conduit with the forehearth, so that practically the same pressure exists in the main furnace zone and in the forehearth and the forehearth is kept hot by the hot furnace gases. In correspondence with the liquid phase continuously reaching the forehearth via the tapping conduit, metal melt and slag both leave the forehearth continuously through their own siphons, the siphons extending from the forehearth at an angle to each other as seen from above. The inlet edge of the siphon inlet for the slag is situated just above the inlet edge of the siphon inlet for the iron, whereas the overflow threshold of the slag siphon outlet is situated below the outlet from the furnace tapping conduit.

The construction of this known cupola furnace and especially the mutual relationship between the outlet of the tapping conduit and the mouths of two siphons is intended to promote continuing reaction between the slag and iron in the forehearth. This is intended to take place in the course of an intensive contact between the two phases in the forehearth, especially owing to their combined turbulence.

The relatively long dwell of the metal and the slag in the forehearth leads, however, to a considerable wear of the lining of the forehearth and this makes frequent repairs necessary and mitigates against long-term uninterrupted operation of the cupola furnace extending over months or even years.

The object of the present invention is to achieve a different process sequence in a cupola furnace by changing the construction of the furnace and thereby to improve the durability of the forehearth to ensure long-term, uninterrupted furnace operation. The present invention is based upon the consideration that the speed of the metal/slag reactions is dependent upon the difference in concentration between these two phases and therefore decreases asymptotically as the concentrations become more equal. Accordingly, the invention aims at restricting the metal/slag reactions, where these occur at high speeds, substantially to the main cupola furnace zone and separating the two phases from each other rapidly in the forehearth to reduce the reaction which takes place there.

To this end, according to this invention, in a continuously tapped cupola furnace having an inclined furnace bottom, a forehearth, a tapping conduit leading from the furnace bottom to the forehearth and siphons for discharging iron and slag from the forehearth, the forehearth has an upper part for holding the slag and a lower part for holding the iron, the upper part having a greater horizontal cross-sectional area than the lower part and the siphons communicating with the lower part.

The volumes of the two parts of the forehearth are with advantage such that, in the upper part of the forehearth there is only slag and the boundary surface between the iron and the slag is situated in the lower part.

This has advantageous results in two aspects. Firstly, due to the larger forehearth cross-section in the upper part, there is a slag column of smaller height, while secondly in the lower part, there is a smaller boundary surface between the metal and the slag corresponding to the smaller cross-section. A shorter slag column has the result that the path of the iron flowing into the forehearth through the slag is shorter, whereas the smaller boundary surface between the metal and the slag results in longer diffusion paths. Preferably, the cross-sectional ratio between the two parts of the forehearth is at least 1:1.4. Further, there is preferably a transition between the lower and upper parts of the forehearth, and this may be of conical form, in order to achieve favourable flow conditions and to prevent breaking away of the forehearth refractory lining.

The furnace bottom, the tapping conduit and an observation duct with a viewing hole are preferably in alignment with one another. In this way the conditions in the furnace zone, in the tapping conduit and in the upper part of the forehearth can best be observed. Since, on account of the high aggressivity of the cupola furnace slag, the slag discharge siphon is among the most highly attacked components of the furnace, the furnace preferably has at least two slag discharge siphons leading from the forehearth. Only one of the siphons is normally in operation at any time. This is of advantage to the extent that the working life of the siphon determines the working life of the forehearth, so that the alternating operation of the slag siphons increases the working life of the forehearth.

The slag siphons are preferably so arranged that the difference in height between the upper edge of the iron discharge siphon duct at the floor of the forehearth and the upper edge of the, or each slag discharge siphon duct is equal to from 0.5 to 1.5 times the cross-sectional height of the iron discharge duct. Also, the length of a level part of the iron discharge duct should be at least twice the cross-sectional height of the duct in order to ensure undisturbed long-term operation in the region of the iron siphon. For the same reason, a bottom plate of the furnace and a bottom plate of the forehearth should be situated at the same level and/or the vertical distance between the inlet opening of the tapping conduit and the furnace bottom plate should be at least 300 mm. This ensures approximately equal service lives for the main furnace zone and forehearth.

Water cooling at the upper sides of the slag siphons also has a pronounced wear-inhibiting effect. However, the water cooling should cease above the iron outlet duct in order to avoid contact between liquid iron and the water seal when the lining has been drastically worn away.

A substantial simplification of the maintenance and repair work at the tapping conduit and forehearth is obtained if the top of the forehearth has an inclination of at least 10° to the horizontal, because then access to the forehearth during repair is substantially facilitated.

An example of a cupola furnace in accordance with the invention is illustrated in the accompanying drawings in which.

Figure 1:
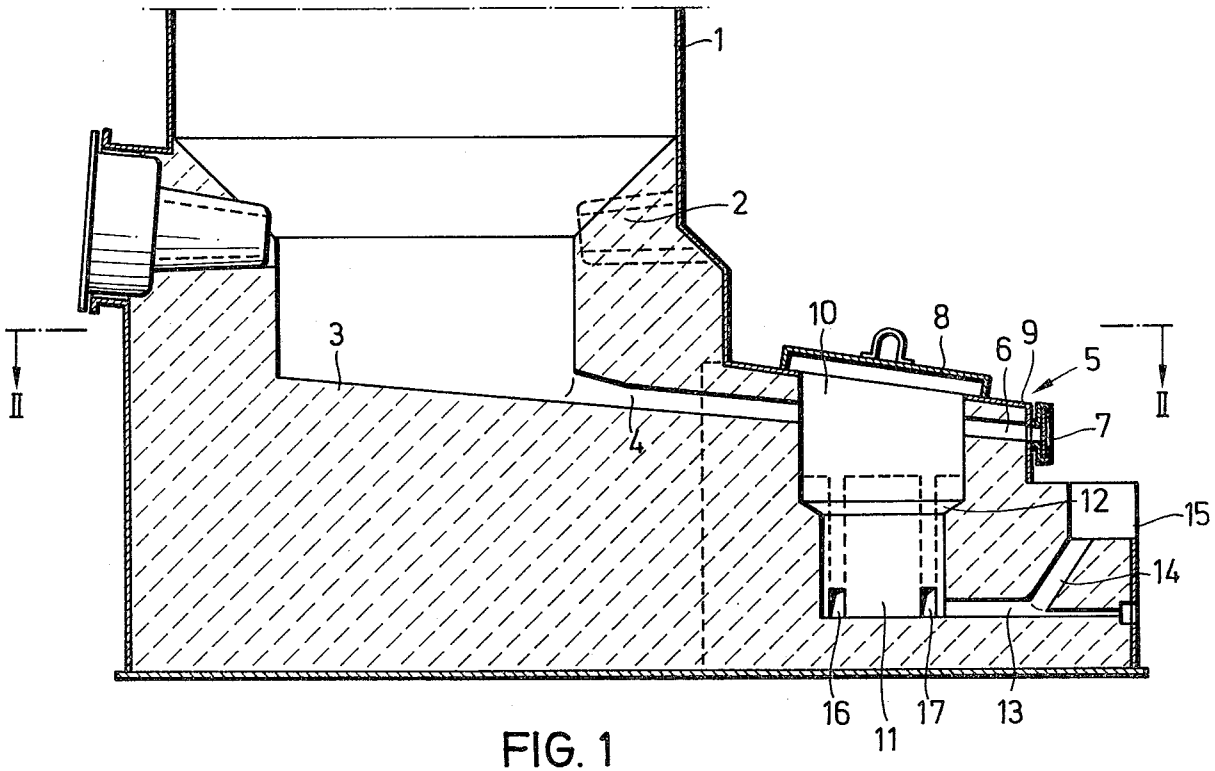
FIG. 1 is a vertical section through the main furnace zone of the furnace and through one of two forehearths.
Figure 2:
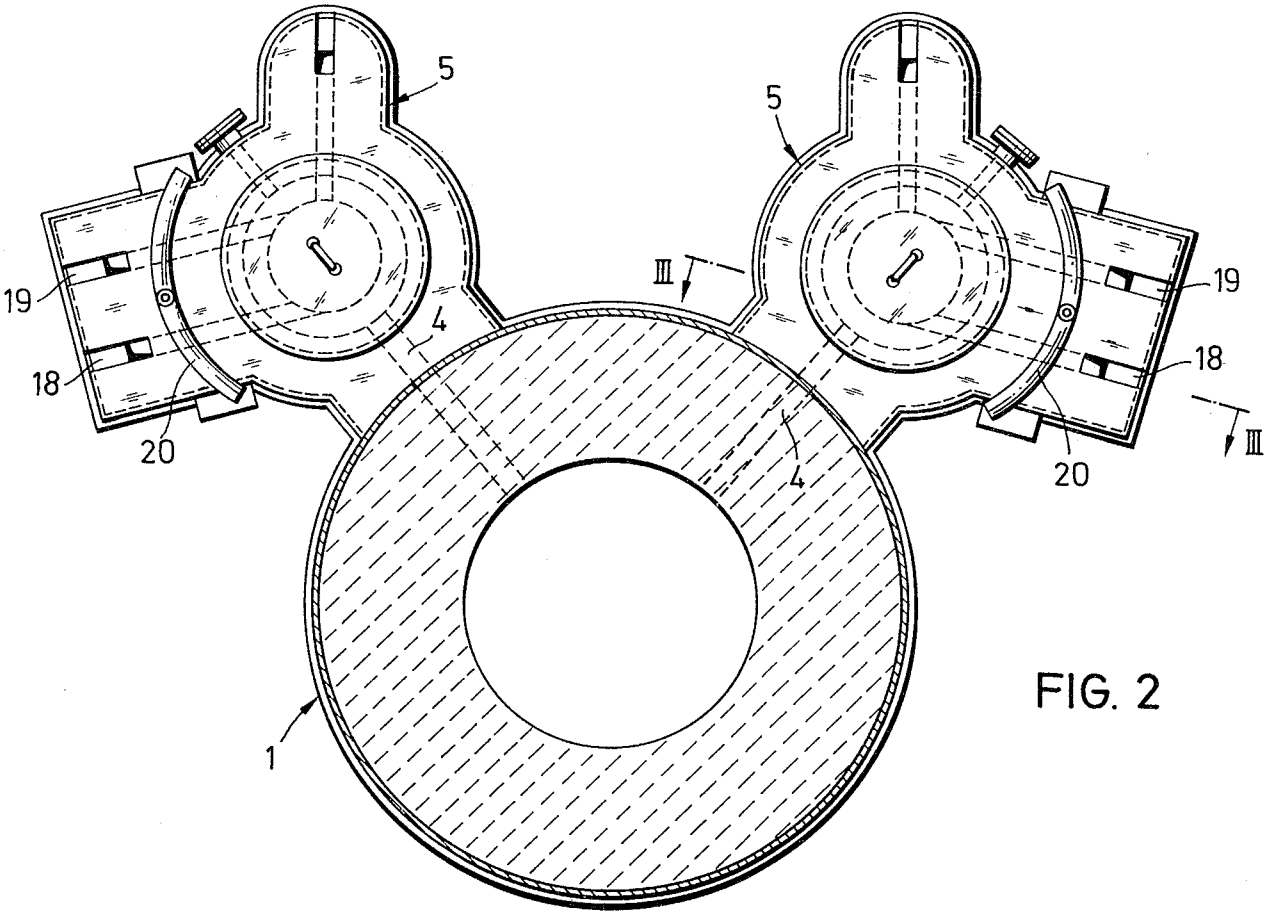
FIG. 2 is a horizontal section on the line II—II in FIG. 1, shown diagrammatically.
Figure 3:
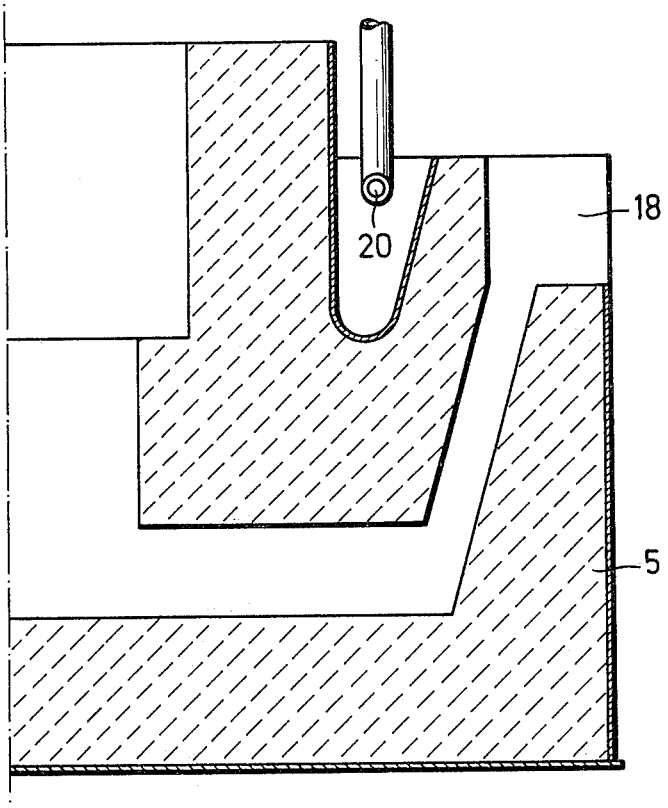
FIG. 3 is a vertical section to a larger scale through part of one of the forehearths along the line III—III in FIG. 2.

A hot-blast cupola furnace 1 has in its main furnace zone, a number of tuyeres 2 located in the usual manner at a distance above an inclined furnace bottom 3. In a direct continuation of the furnace bottom 3, two tapping conduits 4 extend at an angle to each other as seen in plan, to two forehearths 5. The forehearths 5 and the cupola furnace 1 have a common level foundation with a bottom plate.

As the two forehearths are identical, only one of the forehearths will be described.

The tapping conduit 4 leads into an upper part of the forehearth 5 and is aligned with an inspection duct 6 which is diametrically opposite the conduit 4 and has a viewing hole 7, through which the interior of the forehearth and of the main furnace can be observed. In order to make possible repair and maintenance operations, the forehearth has a removable, gastight cover 8 on an inclined top 9 of the forehearth. The removable cover 8 and the inclination of the top 9 of the forehearth facilitate maintenance and repair work on the tapping conduit 4 and the observation duct 6.

The interior of the forehearth consists of an upper slag-holding part 10 having a larger horizontal cross-section, a lower iron-holding part 11 with a smaller horizontal cross-section and a conical transition 12 between the parts 10 and 11. An iron outlet duct 13 extends from the part 11 directly above the forehearth bottom and forms an iron siphon. The duct 13 is initially level and then extends upwards as an ascending duct 14, to an iron overflow 15.

At an angle to the iron siphon 13, 14, 15, two slag outlet ducts 16 and 17 extend from the section 11 parallel to each other and at the same level. These ducts also consist of a horizontal and an ascending portion terminating at overflows 18, 19, and forming slag siphons. Above the slag discharge ducts, there is a water cooling system 20, which brings about a considerable increase in the service life of the slag siphons.

The distance between the upper edge of the iron discharge duct 13 and the upper edges of the mouths of the two slag discharge ducts 16, 17 is equal to from 0.5 to 1.5 times the iron duct height.

Depending upon this distance, the quantity of slag situated in the lower forehearth part 11 will vary and thus the distance to be travelled by the iron through the slag will vary. Moreover, the height of the slag column on the forehearth can also be adjusted by means of the pressure in the main furnace zone, because an equilibrium condition is established between the liquid columns in the three siphons and the iron and slag column in the forehearth and this equilibrium depends upon the main furnace zone pressure, having regard to the substantially constant value of atmospheric pressure.

The drawings show that in the cupola furnace of this invention the metal/slag reactions take place substantially in the "dry zone" between the bed coke column and the furnace bottom and in the tapping conduit, since the two phases are to some extent separated from each other when they enter the forehearth and the iron droplets fall during their travel into the lower part 11 of the forehearth through a comparatively shallow slag column, the height of which can be adjusted by means of the furnace pressure. The evolution of the reactions in the dry zone give rise to the advantage that the reaction between the iron and slag are in the dry zone present in the form of extremely small droplets with correspondingly large reaction surfaces and a high reaction potential. Added to this is a relatively long reaction distance undisturbed by a slag bath, in which the slag-free and consequently dry coke is fully available for the metallurgical reactions. Since moreover the reaction distance between the melt zone and the furnace bottom is constant, there is uniform reaction time which can give rise to a uniform analysis of the refined iron.

I claim:

1. In a continuously tapped cupola furnace including an inclined furnace bottom, a forehearth located laterally from the inclined furnace bottom, a tapping conduit extending between and communicating said furnace bottom with said forehearth and having an inlet end at the furnace bottom and an outlet end in said forehearth, and siphons for discharging iron and slag from said forehearth, the improvement wherein said forehearth includes an upper part for holding slag and a lower part for holding iron, said upper part containing the outlet end of said tipping conduit and having a greater horizontal cross-sectional area than said lower part, and said siphons communicating with said lower part.

2. A furnace as claimed in claim 1, said furnace being a hot-blast cupola furnace.

3. A furnace as claimed in claim 1, in which said cross-sectional area of said lower part and said cross-sectional area of said upper part are in a ratio of at least 1:1.4.

4. A furnace as claimed in claim 1, further comprising means defining a conical transition between said upper part and said lower part of said forehearth.

5. A furnace as claimed in claim 1, further comprising an inspection duct leading into said forehearth, said furnace bottom, said tapping conduit and said inspection duct being in mutual alignment.

6. A furnace as claimed in claim 1, including at least two slag siphons for discharging slag from said forehearth.

7. A furnace as claimed in claim 1, in which said siphon for discharging iron from said forehearth has an inlet in said forehearth and means defining an upper edge of said inlet and said siphon for discharging slag from said forehearth has an inlet in said forehearth and means defining an upper edge of said inlet, said upper edge of said inlet of said slag discharge siphon being at a level above said upper edge of said inlet of said iron discharge siphon by a distance equal to from 0.5 to 1.5 times the height of said inlet of said iron discharge siphon.

8. A furnace as claimed in claim 1, further comprising a duct forming said iron siphon, said duct including a level portion having a length equal to at least twice the height of said duct.

9. A furnace as claimed in claim 1, further comprising a bottom plate of said furnace and a bottom plate of said forehearth at substantially the same level.

10. A furnace as claimed in claim 9, in which said tapping conduit includes an inlet opening, said inlet opening being spaced above said bottom plate by a distance of at least 300 mm.

11. A furnace as claimed in claim 1, further comprising water cooling means for cooling an upper face of said siphon for discharging slag.

12. A furnace as claimed in claim 11, in which said water cooling means terminates short of said siphon for discharging said iron.

13. A furnace as claimed in claim 1, further comprising a top of said forehearth, said top having an inclination to the horizontal of at least 10°, said top being inclined downwardly in a direction away from said furnace bottom.

* * * * *